US008660285B2

(12) United States Patent
Karunasiri

(10) Patent No.: US 8,660,285 B2
(45) Date of Patent: Feb. 25, 2014

(54) ACCESSORY ADAPTER FOR COCHLEAR IMPLANT SYSTEM PROVIDING SIMULTANEOUS T-MIC AND EXTERNAL AUDIO INPUT

(75) Inventor: R. Tissa Karunasiri, Valencia, CA (US)

(73) Assignee: Advanced Bionics AG, Zug (CH)

( * ) Notice: Subject to any disclaimer, the term of this patent is extended or adjusted under 35 U.S.C. 154(b) by 517 days.

(21) Appl. No.: 12/941,498

(22) Filed: Nov. 8, 2010

(65) Prior Publication Data

US 2011/0116669 A1 May 19, 2011

Related U.S. Application Data

(60) Provisional application No. 61/260,857, filed on Nov. 13, 2009.

(51) Int. Cl.
*H04R 25/00* (2006.01)

(52) U.S. Cl.
USPC ..... 381/330; 381/312; 381/23.1; 381/322; 381/324

(58) Field of Classification Search
USPC ..... 381/312, 330, 322, 324, 23.1
See application file for complete search history.

(56) References Cited

U.S. PATENT DOCUMENTS

| | | | | |
|---|---|---|---|---|
| 4,408,608 | A | 10/1983 | Daly et al. | |
| 4,532,930 | A | 8/1985 | Crosby et al. | |
| 4,792,977 | A * | 12/1988 | Anderson et al. | 381/321 |
| 4,947,844 | A | 8/1990 | McDermott | |
| 5,603,726 | A | 2/1997 | Schulman et al. | |
| 5,824,022 | A | 10/1998 | Zilberman et al. | |
| 6,289,247 | B1 | 9/2001 | Faltys et al. | |
| 6,748,094 | B1 * | 6/2004 | Tziviskos et al. | 381/330 |
| 6,754,537 | B1 | 6/2004 | Harrison et al. | |
| 6,775,389 | B2 | 8/2004 | Harrison et al. | |
| 7,020,298 | B1 | 3/2006 | Tziviskos et al. | |
| 7,076,308 | B1 | 7/2006 | Overstreet et al. | |
| 7,142,926 | B2 | 11/2006 | Crawford | |
| 7,167,572 | B1 | 1/2007 | Harrison et al. | |
| 2005/0207602 | A1 * | 9/2005 | van Oerle | 381/312 |
| 2006/0265061 | A1 | 11/2006 | Kwon et al. | |
| 2009/0154738 | A1 * | 6/2009 | Pal | 381/309 |

FOREIGN PATENT DOCUMENTS

WO WO-2005/097255 10/2005

OTHER PUBLICATIONS

International Search Report and Written Opinion received in International Application No. PCT/US2010/055850 dated Nov. 8, 2010.

* cited by examiner

*Primary Examiner* — Davetta W Goins
*Assistant Examiner* — Amir Etesam
(74) *Attorney, Agent, or Firm* — ALG Intellectual Property, LLC

(57) ABSTRACT

A special accessory adapter for use with a BTE device of a cochlear implant (CI) system provides two inputs: a T-Mic input and an auxiliary audio input. Both inputs (the T-Mic input and the auxiliary audio input) are connected to a special mixer circuit integrated into a body of the accessory adapter. The body of the accessory adapter connects to the BTE using the same earhook attachment mechanism used by other accessories used by the CI system. The special mixer circuit prevents signals from either the T-Mic input or the auxiliary audio input from interfering with each other. Both signals, however, can still be processed by the processing circuits of the BTE and combined in such a way that user is able to perceive both signals at the same time.

20 Claims, 6 Drawing Sheets

ACCESSORY ADAPTER FOR COCHLEAR IMPLANT SYSTEM PROVIDING SIMULTANEOUS T-MIC AND EXTERNAL AUDIO INPUT

RELATED APPLICATIONS

The present application claims priority under 35 U.S.C. §119(e) to U.S. Provisional Patent Application No. 61/260,857 by R. Tissa Karunasiri, filed on Nov. 13, 2009, and entitled "Accessory Adapter For Cochlear Implant System Providing Simultaneous T-Mic and External Audio Input," the contents of which are hereby incorporated by reference in their entirety.

BACKGROUND INFORMATION

Cochlear implant ("CI") systems are known in the art. Such systems allow the profoundly deaf (i.e., those whose middle and/or outer ear is dysfunctional, but whose auditory nerve remains intact) to hear. The sensation of hearing is achieved by directly exciting the auditory nerve with controlled impulses of electrical current, which impulses are generated as a function of perceived audio sounds. The audio sounds are picked up by a microphone carried externally (not implanted) by the deaf person and converted to electrical signals. The electrical signals, in turn, are processed and conditioned by a signal processor to generate a control signal, typically a sequence of pulses of varying width and/or amplitude. The control signal, once generated, is transmitted to an implanted pulse generator of the cochlear implant system. The implanted pulse generator, in response to receipt of the control signal, generates appropriate pulses of electrical current that are applied to one or more electrodes of an electrode array that is inserted into the cochlea of the deaf person. It is this electrical current that directly stimulates the auditory nerve and provides the deaf person ("user") with the sensation of hearing. Representative cochlear implant systems are described, e.g., in U.S. Pat. Nos. 4,408,608; 4,532,930; 4,947,844; 5,603,726; 6,289,247; 6,754,537; and 7,076,308, incorporated herein by reference.

Most CI systems have a built-in microphone located in the case or housing of the "headpiece" used with the CI system. The headpiece typically includes, in addition to the built-in microphone, an external coil and a magnet. The magnet is used to align the external coil of the headpiece directly over the location where an implanted coil associated with the implanted pulse generator is located. When the external coil and implanted coils are aligned, the external circuits can optimally and efficiently transmit both data and power signals to the implanted circuits of the implanted pulse generator. Disadvantageously, such positioning of the headpiece rarely, if ever, optimally positions the built-in microphone for picking up sound waves.

Because the built-in microphone located in the headpiece does not always sense sound waves in an optimum manner, a popular type of external microphone used with one type of cochlear implant system is a "T-Mic". A T-Mic is a microphone placed within the concha of the ear near the entrance to the ear canal. Such location is ideal for a microphone because that is the location where sound is naturally collected by the concha of the ear. A T-Mic is described, e.g., in U.S. Pat. Nos. 6,775,389 and 7,020,298, incorporated herein by reference.

The T-Mic is held in its desired position (within the concha of the ear near the entrance of the ear canal) by a boom or stalk that is attached to the ear hook of a behind-the-ear ("BTE") speech processor. A BTE processor not only includes the signal processing circuitry necessary to receive, amplify and process the signals generated by the microphone in response to sensing audio sounds, but also the circuitry needed to transmit the appropriate control signals to the implanted pulse generator. Additionally, the BTE processor typically carries the batteries needed to power the entire CI system.

In order to keep the BTE processor as light weight and small as possible, it is common to limit the number of accessories that may be attached to it. For example, an exemplary BTE processor employs only a single auxiliary input port. This allows only one accessory to be attached to it at any given time. Thus, while multiple accessories are provided that can be attached to the one auxiliary port of the BTE processor, such as a telecoil, a T-Mic, an FM receiver, and an auxiliary connector (where the auxiliary connector allows an MP3 player, or similar external audio signal source, to be connected directly to the processing circuits of the BTE processor), only one such accessory can be used at any given time.

Many cochlear implant users like to use the T-Mic accessory all the time. When they do so the singular auxiliary input port of the BTE is occupied, thereby preventing users from listening to music or using the hands-free connection feature provided by many cell phones at the same time that the T-Mic is attached to the BTE. Simple splitting of the existing auxiliary port (also referred to herein as the "aux" port) interferes with the T-Mic operation and does not allow simultaneous direct connection of an external audio input and the T-Mic. Therefore, there remains a need for users of the T-Mic to also be able to use an auxiliary port at the same that the T-Mic is being used.

One user of a T-Mic, who does not want to disconnect his T-Mic, but who also wants to be able to have auxiliary sound signals be received as input signals into his BTE processor so that he can hear them, has discovered a way to couple such sounds directly into his T-Mic. Such user acoustically couples a conventional ear bud, attached to his MP3 player, iPod or other auxiliary sound source, directly to his T-Mic. This is done by connecting a first end of a short sound tube over the end of the ear bud and then connecting the other end of the short sound tube over his T-Mic. In this way, sounds broadcast from the ear bud are carried by the short sound tube directly to the T-Mic, where they are electrically sensed and processed by the BTE processor of his CI system.

It is thus seen that there is a need in the art for a CI system having a BTE that allows both a T-Mic and an auxiliary audio input to be connected to the BTE at the same time.

SUMMARY

The systems and methods described herein address the above and other needs by providing a special accessory adapter having two inputs, a T-Mic input and an auxiliary audio input, for use at the same time with a Behind-The-Ear (BTE) processor of a cochlear implant (CI) system. Advantageously, both inputs (the T-Mic input and the auxiliary audio input) are connected to a special mixer circuit integrated into the body of the accessory adapter. The body of the accessory adapter connects to the BTE using the same earhook attachment mechanism used by other accessories of the BTE. The special mixer circuit prevents signals from either the T-Mic input or the auxiliary audio input from interfering with each other. Yet, both signals can still be processed by the processing circuits of the BTE and combined in such a way that user is able to perceive both signals at the same time.

The accessory adapter may be implemented as either a one piece unit, having the T-Mic integrally attached thereto, or as a two-piece unit, where the T-Mic plugs into the adapter body as does an auxiliary audio input jack.

The special mixer circuit advantageously enables a user to use his or her T-Mic while listening to music or other external sources at the same time. Typically when the T-Mic operates, the internal conductance variations in the T-Mic creates a voltage across an external element which powers the microphone (e.g., a resistor connected to a power source) which corresponds to the input sound which feeds into the front-end amplifier of the BTE. Similarly, when an auxiliary audio input signal is plugged into the auxiliary input port, another current flows through the input element which corresponds to the electrical signal coming into the auxiliary input port. When both signals are present at the same time, they are "mixed" together in the input element in a mixing ratio that may be 50/50, or any other portion.

In accordance with one feature of the mixing circuit, most of the current available in the circuit is available for use by the T-Mic. Said another way, the mixing circuit does not consume much current from the Aux port, leaving most of the current to be used by the T-Mic. This allows the T-Mic to be powered by the phantom power available from the auxiliary port of the BTE processor. Due to the minimal current consumption by the auxiliary audio input mixing circuitry, the impact on the T-Mic with no auxiliary audio input signal present is negligible. However, when both the T-Mic and an auxiliary audio input signal are present, the total loudness from both sources is limited to the level that the T-Mic can produce on its own due to the current limitation from the processor through the aux port. Therefore the volume control level may stay the same regardless of whether an auxiliary audio input signal is present.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

It is known in the art to use a Behind-The-Ear (BTE) processor or device with a Cochlear Implant (CI) system to provide a T-Mic option. A more detailed description of a BTE device may be found in U.S. Pat. No. 5,824,022, incorporated herein by reference. The T-Mic option, when used, places an external microphone in the concha of the ear near the opening of the ear canal. The T-Mic is fully described, e.g., in one or more of U.S. Pat. Nos. 6,748,094; 6,775,389; 7,020,298; 7,142,926; and 7,167,572; which patents are also incorporated herein by reference. It will be understood that a T-Mic may alternatively be referred to by any other name as may serve a particular implementation. Hence, "T-Mic" as used herein refers generally to any external microphone that is not incorporated into a headpiece (e.g., a microphone that may be placed in the concha of the ear near the opening of the ear canal).

Figure 1A:
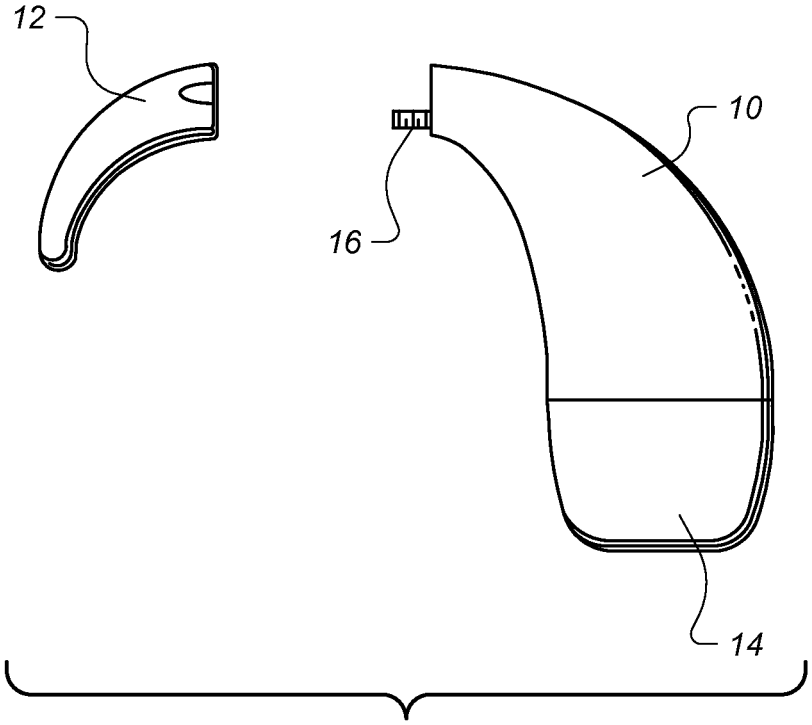
FIG. 1A illustrates a BTE device and earhook with the earhook detached from the BTE device.

A representative BTE device 10, used with a CI system, is illustrated in FIG. 1A. The BTE device includes a detachable earhook 12, and a battery compartment 14. A coaxial connector 16 provides a mechanism for making both mechanical and electrical attachment of a standard earhook 12, as well as other special earhook-type accessories, as described below. That is, the coaxial connector 16 provides the means for attaching an earhook-type accessory, such as the earhook 12, to the main body of the BTE device 10. This type of connection is explained in more detail in U.S. Pat. Nos. 6,748,094 and 7,020,298, previously incorporated herein by reference.

Figure 1B:
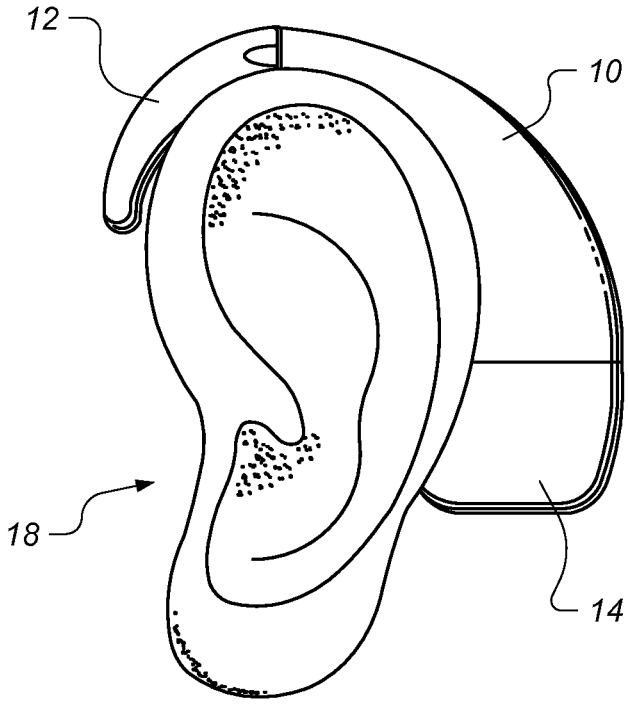
FIG. 1B shows the BTE device with the earhook attached, and with the BTE and earhook being positioned on the ear of a user.

FIG. 1B shows the BTE device 10 with the earhook 12 attached, and with the BTE and earhook being positioned on the ear 18 of a user.

Figure 1C:
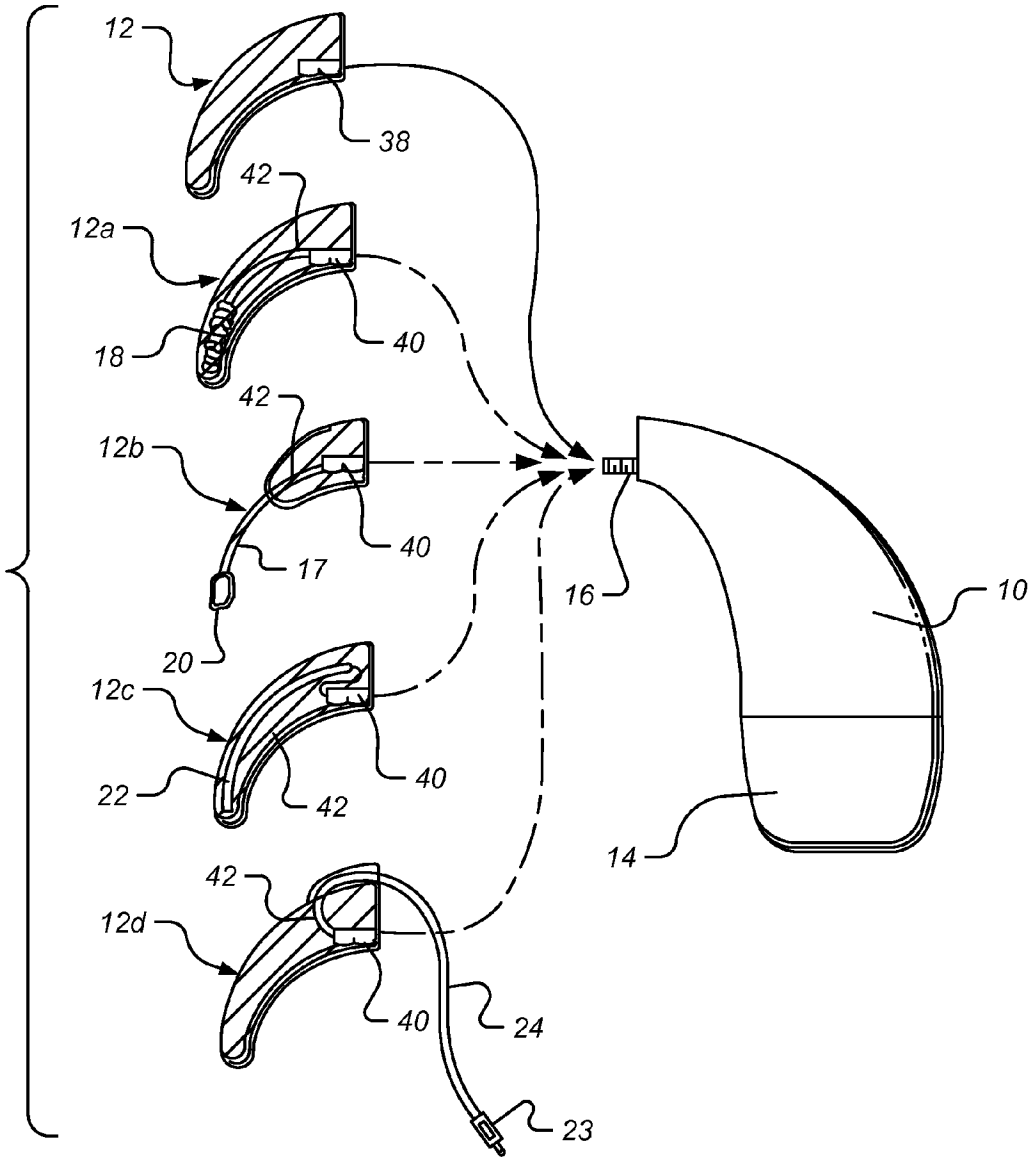
FIG. 1C depicts cross-sectional views of a standard earhook and four special earhooks, which earhooks may be interchangeably attached to the BTE device.

FIG. 1C depicts cross-sectional views of various optional accessories that may be attached to the BTE device 10. As shown in FIG. 1C, for example, a standard earhook 12 may be attached to the BTE device 10. Such earhook 12 helps position and hold the BTE device in its desired location behind the ear 18 (see, e.g., FIG. 1B). The earhook 12 attaches to the BTE device 10 by way of a bore 38 threaded to receive a standard sized thread. Thus, when attaching the earhook 12 to the BTE device 10, the earhook 12, with its threaded bore 38, screws on to the coaxial connector 16 protruding from the body of the BTE device 10. The standard earhook 12 contains no electronic circuits that require an electrical connection with the BTE device 10.

FIG. 1C further shows that a special earhook accessory 12*a* may also be attached to the BTE device 10. Such accessory 12*a* has a telecoil 18 embedded within the earhook. An auxiliary connector 40 is also included as part of this special earhook 12*a*. The auxiliary connector 40 both screws onto the coaxial connector 16 to mechanically mount the special earhook, and provides an electrical connection for leads 42 running from the telecoil 18 to the auxiliary connector 40.

As further seen in FIG. 1C, another special earhook that may be detachably connected to the BTE 10 is a T-Mic 12*b*. The T-Mic 12*b* includes a microphone 20 mounted near the tip of a boom 17 that extends from a proximal end of the T-Mic 12*b*. Wires or leads 42 electrically connect the microphone 20 to the auxiliary connector 40 located in the proximal end of the T-Mic 12*b*. The auxiliary connector 40, in turn, allows the T-Mic 12*b* to be both mechanically and electrically connected to the coaxial connector 16 protruding from the BTE device 10.

As also seen in FIG. 1C, another special earhook accessory 12*c* has an FM receiver 22 embedded therein. Wires or leads 42 electrically connect the FM receiver 22 to the auxiliary connector 40.

Yet another special earhook accessory 12*d* has a cable 24 extending to an input plug 23. The plug 23 is adapted to be plugged into the output jack of a suitable audio signal source device, such as an MP3 player, a CD player, a TV, a radio, or an iPod. Wires or leads 42 embedded within the special earhook 12*d* electrically connect the cable 24 to an auxiliary connector 40. The earhook accessory 12*d* thus allows any audio input source, such as an MP3 player, CD player, or the like, to be connected to the plug 23, which connection in turn allows the audio input source to be connected through the earhook 12*d* to the BTE device 10.

Figure 2:
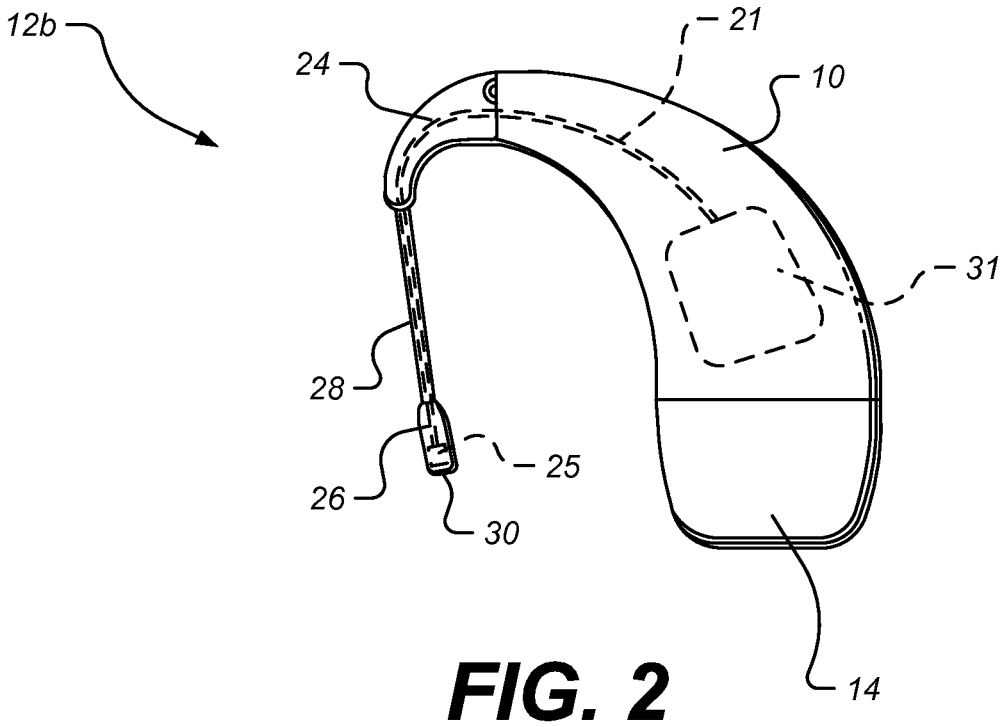
FIG. 2 shows a BTE device with a T-Mic attached.

FIG. 2 shows a BTE device 10 with a T-Mic 12*b* attached. The T-Mic 12*b* includes a proximal earhook portion 24, a microphone assembly 26, and a stalk 28 (also referred to as a boom 17 in FIG. 1C). The stalk 28 mechanically and electrically connects the microphone assembly 26 to the earhook portion 24. The microphone assembly 26 includes a microphone 25 and a soundport 30 at a distal end of the microphone assembly 26. The stalk 28 may be made from a bendable material that retains its bent position, thereby allowing the microphone assembly to be positioned, through selective bending of the stalk 28, at a desired location near the opening of the ear canal. The microphone assembly 26 is electrically connected through wires embedded in the stalk 28, and additional wires 21 within the BTE device 10, to sound processor circuits 31 contained within the BTE unit 10.

Figure 3:
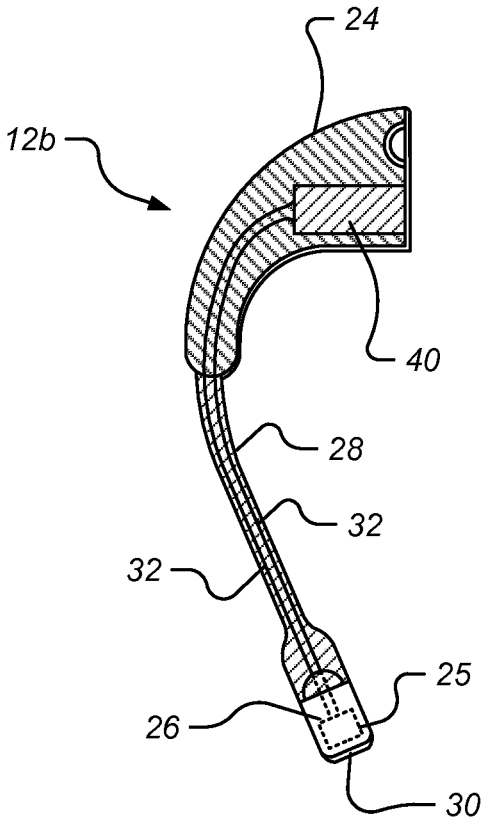
FIG. 3 shows a sectional view of the T-Mic attachment, which T-Mic attachment is configured to attach to a BTE using the same attachment mechanism as used by other earhook-type accessories.

Turning next to FIG. 3, there is shown a sectional view of the T-Mic 12*b*, which T-Mic 12*b* is configured to attach to a BTE device 10 using the same attachment mechanism as is used by other earhook-type accessories. A mating connector 40 is shown schematically residing in the earhook portion 24. Such mating connector 40 may be any connector suitable to electrically and mechanically connect the earhook portion 24 to the BTE device 10.

The T-Mic 12*b* shown in FIG. 3 includes a microphone assembly 26 located at a distal end of a stalk 28. A microphone 25 resides within the microphone assembly 26 adjacent a soundport 30. At least one wire or cable 32 is embedded within the stalk 28 and allows the microphone 25 to be electrically connected with the mating connector 40 located at a proximal end of the T-Mic 12*b*.

Combined, FIGS. 1C, 2 and 3 highlight the problem solved by the systems and methods described herein. That is, even though a desired external audio source device, such as an MP3 or CD player, may be selectively connected to the BTE through use of the special earhook adapter 12*d* shown in FIG. 1C, they can only do so when the T-Mic accessory 12*b* is disconnected from the BTE device 10. This is because there is only one portal gateway into the BTE device, and that is the portal entrance provided through the coaxial connector 16. Thus, all auxiliary electrical connections to the input amplifier(s) of the sound processor 31 must pass through this coaxial connector 16. However, because there is only one coaxial connector 16 provided on the current configuration of the BTE device 10, only one audio input source, including the T-Mic, can be connected to the BTE at any given time.

This problem cannot be remedied by simply attaching a "Y" cable or splitter to the single coaxial connector 16, with each leg of the "Y" going to a separate auxiliary audio source, e.g., one leg being connected to the T-Mic, and the other leg being connected to an external audio source, such as an MP3 player. This is because of the inherent major impedance mismatches between the T-Mic and the audio input circuitry, on the one hand, and between the external audio source and the audio input circuitry, on the other hand. Connecting the T-Mic and external audio source to the same point through a "Y" connector would thus effectively short out one or both of the T-Mic or external audio sources, thereby greatly degrading or interfering with the performance of those devices.

The systems and methods described herein solve this problem by incorporating a second auxiliary input signal port in a T-Mic adapter accessory, and using a special mixer circuit housed within the body of such T-Mic adapter to combine the input signals from both sources, i.e., from the T-Mic and from the external auxiliary input audio source, so that both can be processed by the BTE amplifier, and other processing circuits within the BTE device, without serious signal degradation or interference occurring between the two signals.

Figure 4:
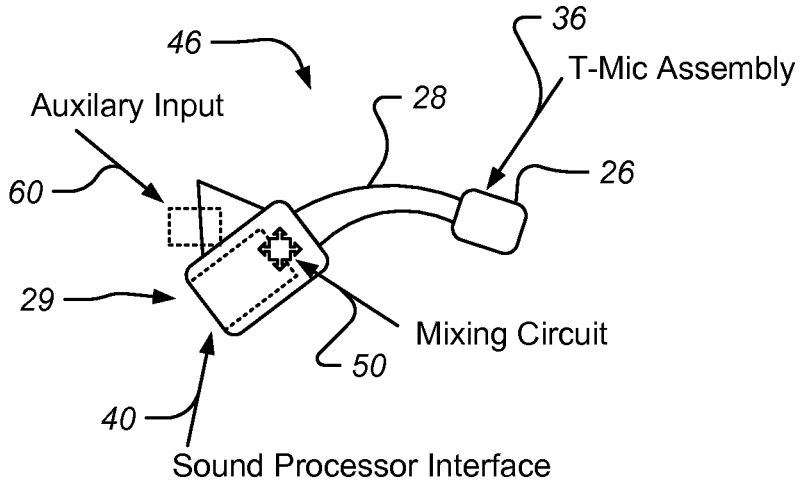
FIG. 4 shows a one piece special T-Mic adapter that provides simultaneous use of both a T-Mic and an auxiliary audio input, which adapter may also be referred to herein as a "one piece T-Mic/Aux-In adapter".

Turning next to FIG. 4, there is shown a one piece T-Mic adapter 46 that provides simultaneous use of both a T-Mic assembly 36 and an auxiliary audio input 60, which adapter 46 may also be referred to herein as a "one piece T-Mic/Aux-In adapter". The one piece T-Mic adapter 46 shown in FIG. 4 includes a housing 29, a T-Mic assembly 26, and a stalk 28. The T-Mic assembly 26 is connected to one end of the stalk 28. The other end of the stalk 28 is integrally attached to the housing 29. The housing 29, in addition to having the T-Mic assembly 26 connected to it by way of the integrally attached stalk, also houses a mixing circuit 50, a sound processor interface connector 40 (also referred to as a "mating connector" in the preceding figures), and an auxiliary input port 60.

Figure 5:
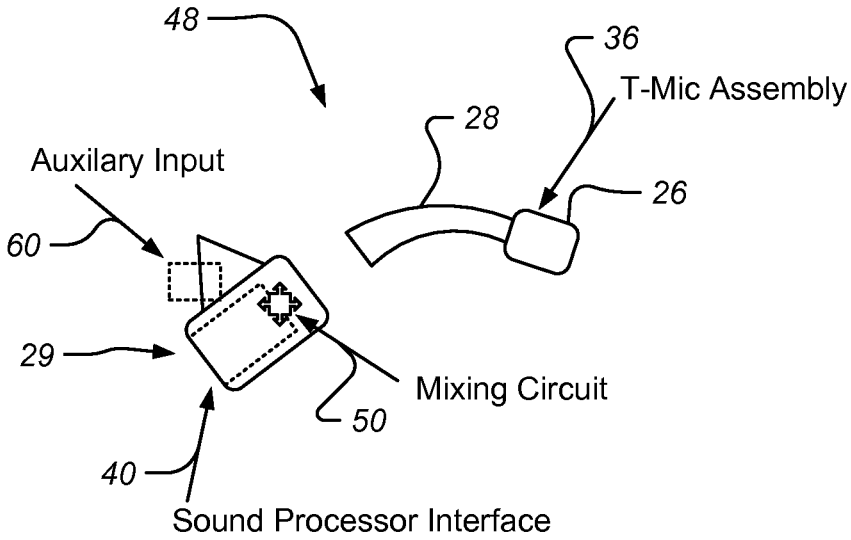
FIG. 5 shows a two piece special T-Mic adapter that provides simultaneous use of both a T-Mic and an auxiliary audio input, which adapter may also be referred to herein as a "two piece T-Mic/Aux-In adapter".

FIG. 5 shows a two piece T-Mic adapter 48 that provides simultaneous use of both a T-Mic assembly 26 and an auxiliary audio input port 60. The T-Mic adapter 48 may also be referred to herein as a "two piece T-Mic/Aux-In adapter". In all material respects the two piece T-Mic/Aux-In adapter 48 is identical to the one piece T-Mic/Aux-In adapter 46 described above in connection with FIG. 4, except that the stalk 48 is detachable from the housing 29.

Figure 6:
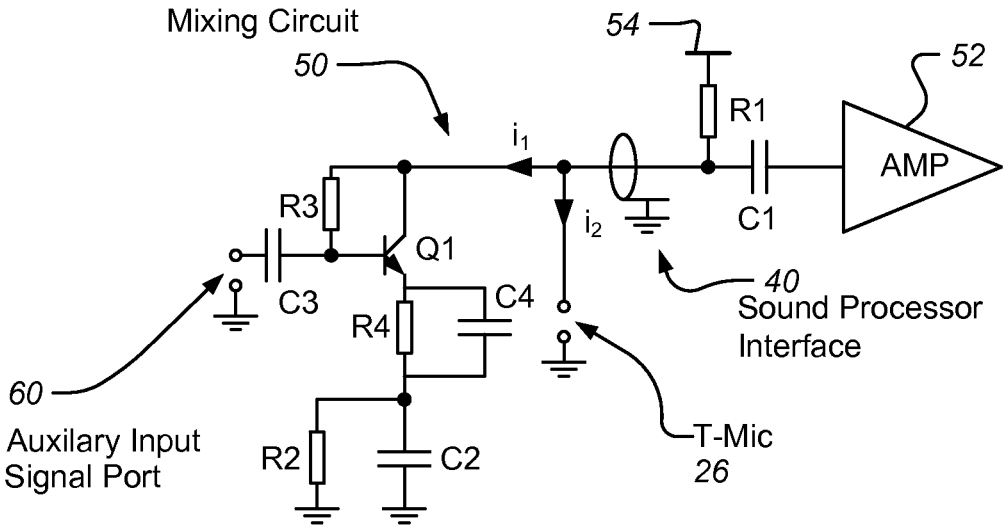
FIG. 6 illustrates an exemplary mixer circuit used within the T-Mic/Aux-In Adapter described herein.

FIG. 6 schematically illustrates the mixer circuit 50 used within the T-Mic/Aux-In Adapter 46 or 48 described herein. As seen in FIG. 6, the mixer circuit 50 includes a port or connection for the T-Mic assembly 26 and an auxiliary input 60. The T-Mic assembly 26 feeds directly into an amplifier 52, via the sound processor interface connector 30, through coupling capacitor C1. The T-Mic assembly 26 receives its operating power through resistor R1, which resistor R1 is connected to a suitable power supply voltage or potential 54. When thus connected, a bias current i2 flows through the T-Mic 26. It is this bias current i2 that allows the T-Mic 26 to operate. As the T-Mic 26 senses audio sounds, those sounds are reflected in variations of the current i2, and thus appear as variations in voltage across resistor R1, which variations in voltage are then amplified by amplifier 52 and processed by the processing circuits contained within the BTE 10.

Further included in the mixing circuit 50 is auxiliary input circuitry that enables an auxiliary input signal source to be connected to the amplifier 52 without adversely loading down the T-Mic signal level. As seen in FIG. 6, such auxiliary input circuitry includes a port 60 into which the auxiliary signal source can be connected. This port is connected to the base of NPN transistor Q1 through a coupling capacitor C3. The transistor Q3 includes biasing resistor R3 connected across its collector and base terminals. The emitter terminal of transistor Q1 is connected to the series combination of resistors R4 and R2, with one end of resistor R4 being connected to the emitter of transistor Q1, and with the other end of R4 being connected to one end of resistor R2. The other end of resistor R2 is connected to ground. A capacitor C4 is connected across resistor R4. Another capacitor C2 is connected across resistor R2. These 4 components (R2, R4, C2 and C4) allow additional pre-determined frequency shaping of the Auxiliary input when required by the BTE processor. This is performed by changing the component values or eliminating one or both capacitors and one resistor. As a minimum one resistor needs to be connected between the emitter terminal of the NPN transistor to ground of the mixing circuit.

The electronic mixer circuit 50, with both a T-Mic 26 and an auxiliary input signal source 60 connected thereto, enables its user to use a T-Mic while listening to music or other external sources that are plugged into the Auxiliary Input signal port. As indicated above, when the T-Mic operates, the current i2 from the T-Mic develops a voltage across resistor R1 corresponding to the input sound which feeds into the amplifier 52. A current i1, corresponding to the auxiliary signal source input, also flows through resistor R1 creating a corresponding electrical signal. Appropriately selected component values in the circuit, principally resistors R1, R4 and R2, allow the mixing ratio to be 50/50 or any other proportion.

One feature of the mixing circuit 50 is that it will not consume much dc current from the Aux Input port 60, leaving most of the current to be used by the T-Mic. This is done by setting resistor R2 to a relatively high value. Transistor Q1 is basically acting as an AC signal amplifier with minimal current consumption, while maintaining the existing two wire interface from the BTE processor.

The mixing circuitry 50 and the T-Mic 26 are powered by the phantom power available from the auxiliary port (sound processor interface 40) of the BTE device 10. Due to the minimal current consumption of the mixing circuitry 50, the impact on the T-Mic current i2 when no auxiliary input signal source is connected is negligible. That is, when no auxiliary input signal source is connected, current i1 is small and negligible compared to the current i2.

When both a T-Mic 26 and an auxiliary signal source 60 are connected to the mixing circuitry 50, the current i1 is no longer negligible, but neither is it so large that it totally swamps out or overwhelms the T-Mic current i2. Rather, both currents i2 and i1 assume values that allow both to perform their desired function, i.e., to develop voltage swing variations across resistor R1 that represent accurate and non-distorted voltage variations of the actual input signals applied to the auxiliary input signal port 60 or produced by the T-Mic assembly 26. These two signals are thus combined together across resistor R1. The resulting combined signal is then amplified by amplifier 52 and processed by the BTE circuits, thereby allowing the user to use his or her beloved T-Mic while listening to music or other external sources which are plugged into the auxiliary input signal port.

Another feature of the mixing circuitry 50 is that the total loudness from both sources (the auxiliary input signal source and the T-Mic source) is limited to the level that the T-Mic 26 source could produce on its own. This occurs because the circuitry limits the amount of current that can flow from the BTE processor through the auxiliary input signal port. (This limit is basically set by the value of the voltage potential at voltage source 54 and resistor R1.) Therefore, the volume control level may remain substantially the same regardless of whether one or two signal sources are being applied to the BTE through the mixing circuit 50.

Figure 7:
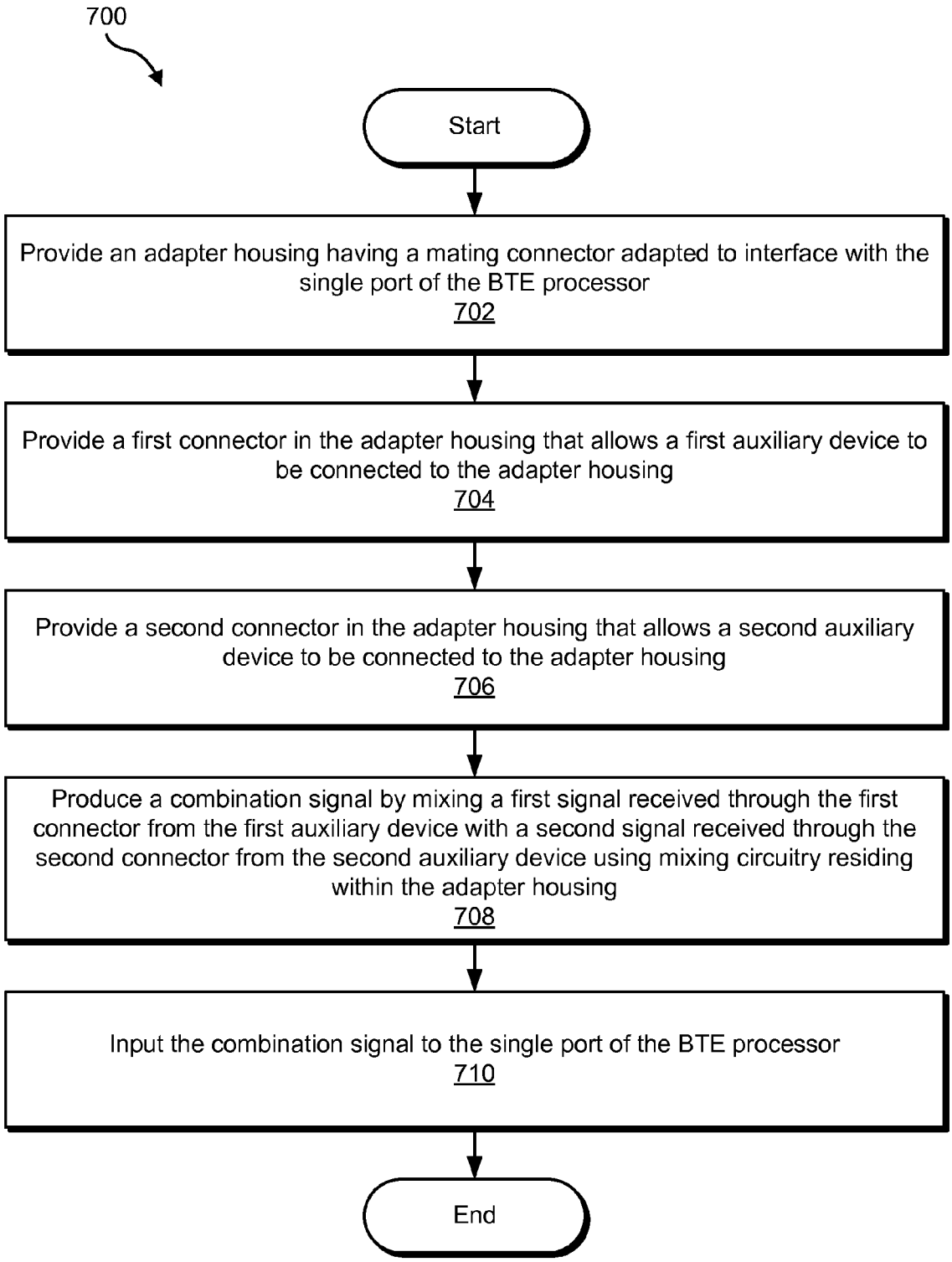
FIG. 7 illustrates an exemplary method of connecting two auxiliary devices to a BTE processor having only a single port.

FIG. 7 illustrates an exemplary method 700 of connecting two auxiliary devices to a BTE processor having only a single port. While FIG. 7 illustrates exemplary steps according to one embodiment, other embodiments may omit, add to, reorder, and/or modify any of the steps shown in FIG. 7.

In step 702, an adapter housing is provided that has a mating connector adapted to interface with the single port of the BTE processor. Step 702 may be performed in any of the ways described herein.

In step 704, a first connector is provided in the adapter housing that allows a first auxiliary device to be connected to the adapter housing. Step 704 may be performed in any of the ways described herein.

In step 706, a second connector is provided in the adapter housing that allows a second auxiliary device to be connected to the adapter housing. Step 704 may be performed in any of the ways described herein.

In step 708, a combination signal is produced by mixing a first signal received through the first connector from the first auxiliary device with a second signal received through the second connector from the second auxiliary device using mixing circuitry residing within the adapter housing. Step 708 may be performed in any of the ways described herein.

In step 710, the combination signal is input to the single port of the BTE processor. Step 710 may be performed in any of the ways described herein.

As described above, the systems and methods described herein may provide an adapter for use with a BTE processor of a cochlear implant system that allows both a T-Mic signal and an auxiliary input signal source to be processed by the BTE processor simultaneously. The adapter may include an adapter housing having an auxiliary input signal source port, means for connecting the adapter housing to the BTE processor, means for electrically and mechanically connecting a T-Mic assembly to the adapter housing, the T-Mic assembly configured to output the T-Mic signal, and a mixing circuit adapted to mix the T-Mic signal with an auxiliary input signal applied to the auxiliary input signal port. The mixing circuit may be configured to derive an operating power from the BTE processor and include limiting means for limiting a magnitude of a combined signal resulting from the mixing of the T-Mic signal with the auxiliary input signal to a level that is no greater than the T-Mic signal would be if there were no auxiliary input signal applied to the auxiliary input signal source.

Additionally or alternatively, in a BTE processor used with a cochlear implant system, where the BTE processor has only one port for connecting one auxiliary device to the BTE processor at a time, an adapter that allows two auxiliary devices to be attached to the BTE processor at the same time may include an adapter housing and a mixing circuit within the adapter housing. The adapter housing may have a mating connector adapted to interface with the one port of the BTE processor, a first connection means for allowing a first auxiliary device to be detachably connected to the adapter housing, and a second connection means for allowing a second auxiliary device to be detachably connected to the adapter housing. The mixing circuit may receive operating power from the BTE processor through the one port and be connected in circuit relationship with the first connection means and the second connection means. The mixing circuit is further configured to combine first and second input signals received through the first and second connection means from the first and second auxiliary devices, respectively, to produce a combination signal and to present the combination signal to the mating connector, whereby the combination signal is processed by the BTE processor, whereby the first and second auxiliary devices are connected to the BTE processor at the same time.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. An adapter for use with a Behind-The-Ear (BTE) processor of a cochlear implant (CI) system that allows both a T-Mic signal and an auxiliary input signal source to be processed by the BTE processor simultaneously, the adapter comprising:

an adapter housing having an auxiliary input signal source port;

means for connecting the adapter housing to the BTE processor;

means for electrically and mechanically connecting a T-Mic assembly to the adapter housing, the T-Mic assembly configured to output the T-Mic signal; and a mixing circuit adapted to mix the T-Mic signal with an auxiliary input signal applied to the auxiliary input signal port, the mixing circuit deriving an operating power from the BTE processor and including limiting means configured to limit an amount of current that flows from the BTE processor through the auxiliary input signal source port to automatically limit a magnitude of a combined signal resulting from the mixing of the T-Mic signal with the auxiliary input signal to a level that is no greater than the T-Mic signal would be if there were no auxiliary input signal applied to the auxiliary input signal source port; and an amplifier that receives and amplifies the combined signal for processing by the BTE processor.

2. The adapter of claim 1, wherein the means for connecting the adapter housing to the BTE processor comprises a detachable means that allows selective attachment or detachment of the T-Mic assembly to or from the BTE processor.

3. The adapter of claim 1, wherein the auxiliary input signal source port of the mixing circuit is connected through a first coupling capacitor to a base terminal of a transistor, and wherein a collector terminal of the transistor is connected to an input node, the input node also being electrically connected to the T-Mic, and wherein an emitter terminal of the transistor is connected to ground through at least one resistor, the input node being detachably and electrically connected through a second coupling capacitor to an input circuit of the BTE processor, the input node also being connected through at least one resistor to a voltage potential.

4. The adapter of claim 3, wherein the voltage potential originates within the BTE processor.

5. The adapter of claim 1, wherein the T-Mic comprises a microphone configured to be positioned in the concha of the ear near the opening of the ear canal of the BTE user.

6. The adapter of claim 1, further comprising means for disconnecting the adapter housing from the BTE processor.

7. The adapter of claim 1, further comprising means for electrically and mechanically disconnecting the T-Mic assembly from the adapter housing.

8. The adapter of claim 1, wherein the adapter housing is configured to be positioned on an ear of a user.

9. The adapter of claim 1, wherein the auxiliary input signal is provided by an auxiliary audio input device selected from the group comprising an MP3 player, a radio, a television, an iPod, a telephone, a cell phone, and a computer.

10. In a Behind-The-Ear (BTE) processor used with a Cochlear Implant (CI) system, where the BTE processor has only one port for connecting one auxiliary device to the BTE processor at a time, an adapter that allows two auxiliary devices to be attached to the BTE processor at the same time, the adapter comprising:

an adapter housing having a mating connector adapted to interface with the one port of the BTE processor, the housing having a first connection means for allowing a first auxiliary device to be detachably connected to the adapter housing, and a second connection means for allowing a second auxiliary device to be detachably connected to the adapter housing;

a mixing circuit within the adapter housing and connected in circuit relationship with the first connection means and the second connection means, the mixer circuit receiving operating power from the BTE processor through the one port and configured to combine first and second input signals received through the first and second connection means to produce a combination signal; and an amplifier within the adapter housing and that receives and amplifies the combination signal for processing by the BTE processor;

wherein the mixing circuit is further configured to limit an amount of current that flows from the BTE processor through the one port to automatically limit a magnitude of the combination signal to a level that is no greater than the first input signal would be if the second input signal were not applied to the one port.

11. The adapter of claim 10, wherein the first auxiliary device comprises a T-Mic accessory that positions a microphone assembly near the opening of the ear canal of the ear on which the BTE processor is placed.

12. The adapter of claim 11, wherein the first connection means locks the T-Mic accessory to the adapter housing.

13. The adapter of claim 10, wherein the mixing circuit combines the first input signal and the second input signal in a way that preserves both the first input signal and the second input signal without having distortion or interference degrade either the first input signal or the second input signal when both are present.

14. The adapter of claim 10, wherein the second auxiliary device comprises an auxiliary audio input device selected from the group comprising an MP3 player, a radio, a television, an iPod, a telephone, a cell phone, and a computer.

15. The adapter of claim 10, wherein the mixing circuit includes means for combining the first input signal and the second input signal by drawing a first current, corresponding to a current generated in response to the first auxiliary device, and a second current, corresponding to a current generated in response to the second auxiliary device, through a common resistor and common node within the mixing circuit, whereby a voltage swing is generated at the common node corresponding to changes in the first current and changes in the second current.

16. The adapter of claim 10, wherein the adapter housing is configured to selectively disconnect from the BTE processor.

17. The adapter of claim 10, wherein the adapter housing is configured to be positioned on an ear of a user.

18. In a Behind-The-Ear (BTE) processor used with a Cochlear Implant (CI) system, where the BTE processor has only a single port for connecting one auxiliary device to the BTE processor at a time, a method for connecting two auxiliary devices to the BTE processor at the same time, the method comprising:

providing an adapter housing having a mating connector adapted to interface with the single port of the BTE processor;

providing a first connector in the adapter housing that allows a first auxiliary device to be connected to the adapter housing;

providing a second connector in the adapter housing that allows a second auxiliary device to be connected to the adapter housing;

producing a combination signal by mixing a first signal received through the first connector from the first auxiliary device with a second signal received through the second connector from the second auxiliary device using mixing circuitry residing within the adapter housing;

amplifying the combination signal for processing by the BTE processor;

limiting an amount of current that flows from the BTE processor through the single port to automatically limit a magnitude of the combination signal to a level that is no greater than the first signal would be if there were no second signal received through the second connector; and inputting the amplified combination signal to the single port of the BTE processor.

19. The method of claim 18, wherein producing the combination signal comprises combining the first input signal and the second input signal by drawing a first current, corresponding to a current generated in response to the first auxiliary device, and a second current, corresponding to a current generated in response to the second auxiliary device, through a common resistor and common node within the mixing circuitry, thereby generating a voltage swing at the common node that represents the combination signal.

20. The method of claim 18, wherein the first auxiliary device comprises a T-Mic accessory and the second auxiliary device comprises an auxiliary audio input device.

* * * * *